US008919234B2

(12) United States Patent
Aby-Eva et al.

(10) Patent No.: US 8,919,234 B2
(45) Date of Patent: Dec. 30, 2014

(54) MANDOLINE SLICER

(71) Applicant: Helen of Troy Limited, Belleville, St. Michael (BB)

(72) Inventors: Gregoire B. Aby-Eva, Pittsburgh, PA (US); Hyukjae Chang, Pittsburgh, PA (US); Eric R. Colburn, Wexford, PA (US); Thomas W. Hartman, Pittsburgh, PA (US); Dino A. Mariano, Bridgeville, PA (US)

(73) Assignee: Helen of Troy Limited, Belleville, St. Michael (BB)

( * ) Notice: Subject to any disclaimer, the term of this patent is extended or adjusted under 35 U.S.C. 154(b) by 205 days.

(21) Appl. No.: 13/755,109

(22) Filed: Jan. 31, 2013

(65) Prior Publication Data

US 2014/0208916 A1 Jul. 31, 2014

(51) Int. Cl.
*B26D 1/02* (2006.01)

(52) U.S. Cl.
USPC ..... 83/440.2; 83/698.11; 83/856; 83/932

(58) Field of Classification Search
USPC ..... 83/856–858, 440.2, 698.11, 698.51, 83/932
See application file for complete search history.

(56) References Cited

U.S. PATENT DOCUMENTS

| | | | | |
|---|---|---|---|---|
| 4,573,387 | A | 3/1986 | Denter et al. | |
| 4,733,588 | A * | 3/1988 | Yamamoto | 83/857 |
| 6,082,645 | A | 7/2000 | Himmighofen et al. | |
| 7,143,677 | B2 | 12/2006 | Zeder et al. | |
| 7,621,207 | B2 * | 11/2009 | Botsai et al. | 83/698.11 |
| 8,069,766 | B2 * | 12/2011 | De Buyer et al. | 83/856 |
| 8,151,678 | B2 | 4/2012 | Mah et al. | |
| 8,181,560 | B2 * | 5/2012 | Hauser et al. | 83/858 |
| 8,430,010 | B2 * | 4/2013 | Holmes et al. | 83/856 |
| 8,438,961 | B2 * | 5/2013 | Repac | 83/440.2 |
| 8,839,702 | B2 * | 9/2014 | Bagley | 83/435.11 |
| 2004/0200366 | A1 * | 10/2004 | Koerselman et al. | 99/537 |
| 2004/0231482 | A1 * | 11/2004 | Boilen | 83/425.3 |
| 2005/0061124 | A1 * | 3/2005 | Vincent | 83/247 |
| 2006/0075872 | A1 * | 4/2006 | Wangler | 83/856 |
| 2006/0081108 | A1 * | 4/2006 | de Buyer | 83/703 |
| 2006/0123639 | A1 * | 6/2006 | Boerner | 30/404 |
| 2006/0283299 | A1 * | 12/2006 | Mellen et al. | 83/401 |
| 2007/0062349 | A1 * | 3/2007 | Ishii | 83/13 |
| 2007/0089577 | A1 * | 4/2007 | Wong | 83/13 |

(Continued)

OTHER PUBLICATIONS

International Search Report filed in PCT/US2014/010614 mailed May 12, 2014.

*Primary Examiner* — Sean Michalski
(74) *Attorney, Agent, or Firm* — Rankin, Hill & Clark LLP

(57) ABSTRACT

A food slicer includes a frame for supporting a landing and a runway movable relative to the landing. A cutting blade is secured on an upstream end of the landing. A downstream end of the runway is spaced from an edge of the cutting blade. A separate cutting knife is moveably connected to the frame. An adjustment mechanism connected to the frame adjusts an offset between the cutting blade and the runway. The adjustment mechanism includes spaced apart first and second guide tracks provided on respective first and second movable side members. The guide tracks are configured such that a first movement of the adjustment mechanism moves the downstream end of the runway relative to the cutting blade to adjust a cutting thickness and a second movement of the adjustment mechanism lowers the downstream end of the runway and raises the cutting knife to a working position.

20 Claims, 13 Drawing Sheets

(56) References Cited

U.S. PATENT DOCUMENTS

| | | | | |
|---|---|---|---|---|
| 2007/0137457 | A1* | 6/2007 | Botsai et al. | 83/858 |
| 2008/0098866 | A1* | 5/2008 | DiPietro | 83/440.2 |
| 2008/0257128 | A1 | 10/2008 | Reimann et al. | |
| 2009/0123623 | A1* | 5/2009 | Tweg | 426/518 |
| 2009/0255391 | A1* | 10/2009 | Hood et al. | 83/648 |
| 2010/0162869 | A1 | 7/2010 | Smith et al. | |
| 2011/0120279 | A1* | 5/2011 | Braun | 83/13 |
| 2011/0132161 | A1* | 6/2011 | Robbins | 83/13 |
| 2013/0232800 | A1* | 9/2013 | Holmes et al. | 30/286 |
| 2014/0208916 | A1* | 7/2014 | Aby-Eva et al. | 83/699.51 |

* cited by examiner

MANDOLINE SLICER

BACKGROUND

Exemplary embodiments herein generally relate to a food slicer, and, in particular, to an adjustment mechanism for a food slicer.

Food slicers of a type known as mandoline slicers are well known and very popular for slicing and cutting raw and cooked food items in various shapes, thicknesses and forms. Mandoline slicers have a blade having a blade body and a leading blade edge on the blade body for cutting food. Mandoline slicers also generally include an infeed deck or runway having a support surface spaced from an outfeed deck or landing having the cutting blade. The slicer is operated by directing a quantity of food in a direction toward the blade edge to be cut. A bulk quantity of food is typically placed on the support surface of the runway, and then slid across the runway toward the blade edge. The blade is offset from the runway, and the offset distance provides a thickness or depth of the cut made in the food as it is pushed into the blade. After the food passes by the blade, the uncut portion passes above the blade and onto a landing, and the sliced portion passes below the blade and separates from the rest of the food bulk.

In order to select a slice thickness, some mandoline slicers are adjustable. That is, the slicer is adjustable so that the offset between the blade and the runway may be selected. In the prior art, several techniques are employed to vary the spacing between the item feeding surface and the blade edge to control the thickness of the cut. Each of these techniques has its limitations.

BRIEF DESCRIPTION

In accordance with one aspect, a mandoline-type food slicer for slicing food advanced in a cutting direction comprises a frame for supporting a landing and a runway, which is movable relative to the landing. A cutting blade is secured on an upstream end of the landing. A downstream end of the runway is spaced from an edge of the cutting blade to define an opening for the passage of sliced food. A separate cutting knife is moveably connected to the frame. An adjustment mechanism is connected to the frame and configured to adjust an offset between the cutting blade and the runway. The adjustment mechanism includes spaced apart first and second guide tracks provided on respective first and second movable side members. The first and second guide tracks are configured such that a first movement of the adjustment mechanism from a locked position of the food slicer lowers the downstream end of the runway relative to the cutting blade to adjust a cutting thickness and a second movement of the adjustment mechanism from the locked position lowers the downstream end of the runway and raises the cutting knife to a working position.

In accordance with another aspect, a mandoline-type food slicer for slicing food advanced in a cutting direction comprises a frame for supporting a landing and a runway, which is movable relative to the landing. A cutting blade is secured on an upstream end of the landing. A downstream end of the runway is spaced from an edge of the cutting blade to define an opening for the passage of sliced food. An adjustment mechanism is connected to the frame and configured to adjust an offset between the cutting blade and the runway. The adjustment mechanism includes a slide button connected to first and second movable side members provided on opposed longitudinal sides of the frame. Each of the first and second movable side members includes a first guide track. Each first guide track is configured such that a first lateral movement of the slide button from a locked position of the food slicer lowers a downstream end of the runway relative to the cutting blade to adjust a cutting thickness. The first guide track of the first movable side member is vertically offset from the first guide track of the second movable side member causing the downstream end of the runway to twist as the offset between the cutting blade and the runway is adjusted by the adjustment mechanism.

In accordance with yet another aspect, a mandoline-type food slicer for slicing food advanced in a cutting direction comprises a frame for supporting a landing and a runway, which is movable relative to the landing. A cutting blade is secured on an upstream end of the landing. A downstream end of the runway is spaced from an edge of the cutting blade to define an opening for the passage of sliced food. A separate cutting knife is moveably connected to the frame. The second cutting knife has julienne blades which project upwardly through openings provided on the downstream end of the runway. An adjustment mechanism is connected to the frame and configured to adjust an offset between the cutting blade and the runway. The adjustment mechanism includes first and second movable side members which are displaceable along a length of the frame and a slide button. Each of the first and second movable side members includes spaced apart first and second guide tracks. A first arm extends from the first movable side member and a second arm extends from the second movable side member, and respective ends of the first and second arms are connected to the slide button. The guide tracks are configured such that a movement of the slide button in a first direction generally perpendicular to a longitudinal axis of the food slicer raises a downstream end of the runway relative to the cutting blade to adjust a cutting thickness and a second movement of the slide button in the first direction lowers the downstream end of the runway and simultaneously raises the cutting knife.

DETAILED DESCRIPTION

It should be understood that the description and drawings herein are merely illustrative and that various modifications and changes can be made in the structures disclosed without departing from the present disclosure. In general, the figures of the exemplary mandoline-type food slicer are not to scale. It should be appreciated that the term "plurality" means "two or more", unless expressly specified otherwise. For the sake of description, terms used herein such as the term downstream refers to the direction in which food is moved for cutting, and the term upstream refers to a direction opposite to the direction for cutting the food bulk. The thickness is the thickness of the slice of the food bulk made by the food slicer. It will also be appreciated that the various identified components of the exemplary mandoline-type food slicer disclosed herein are merely terms of art that may vary from one manufacturer to another and should not be deemed to limit the present disclosure.

Figure 1:
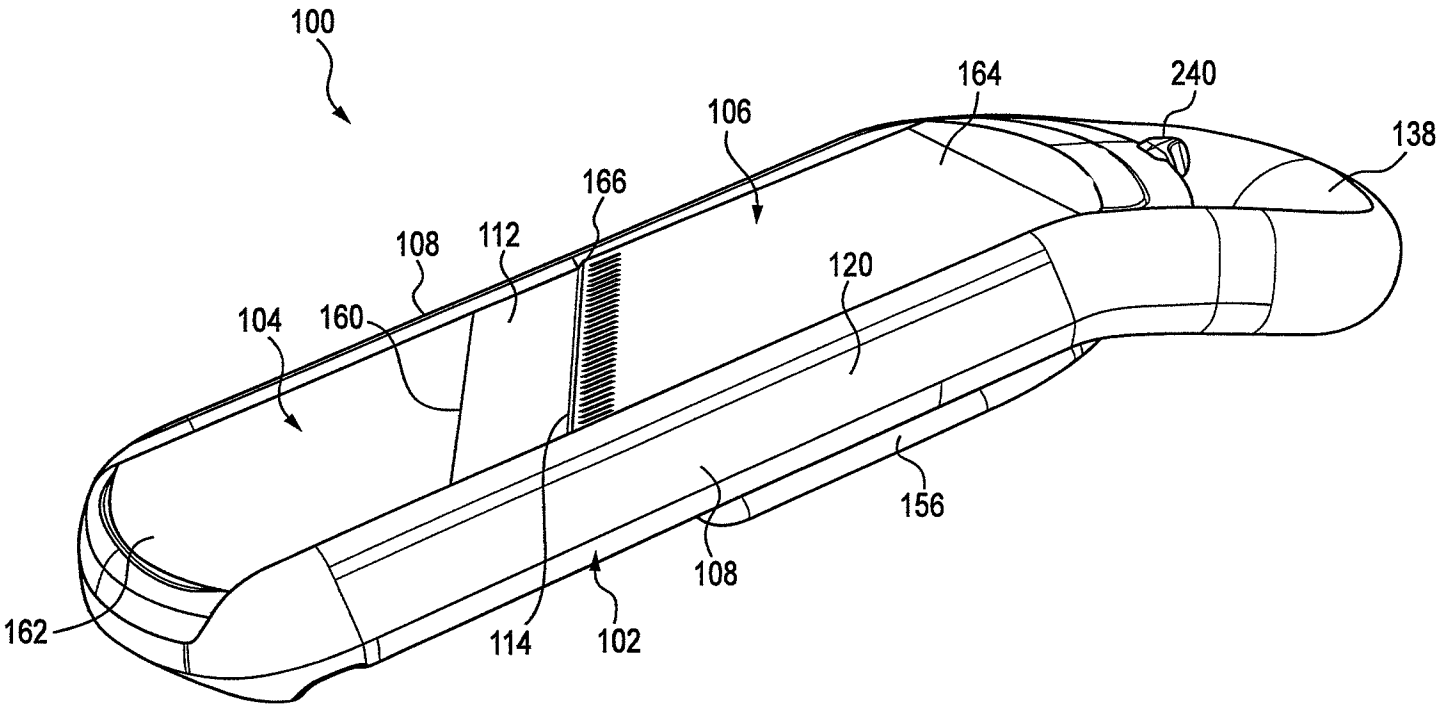
FIG. 1 is a perspective view of an exemplary mandoline-type food slicer according to the present disclosure.
Figure 2:
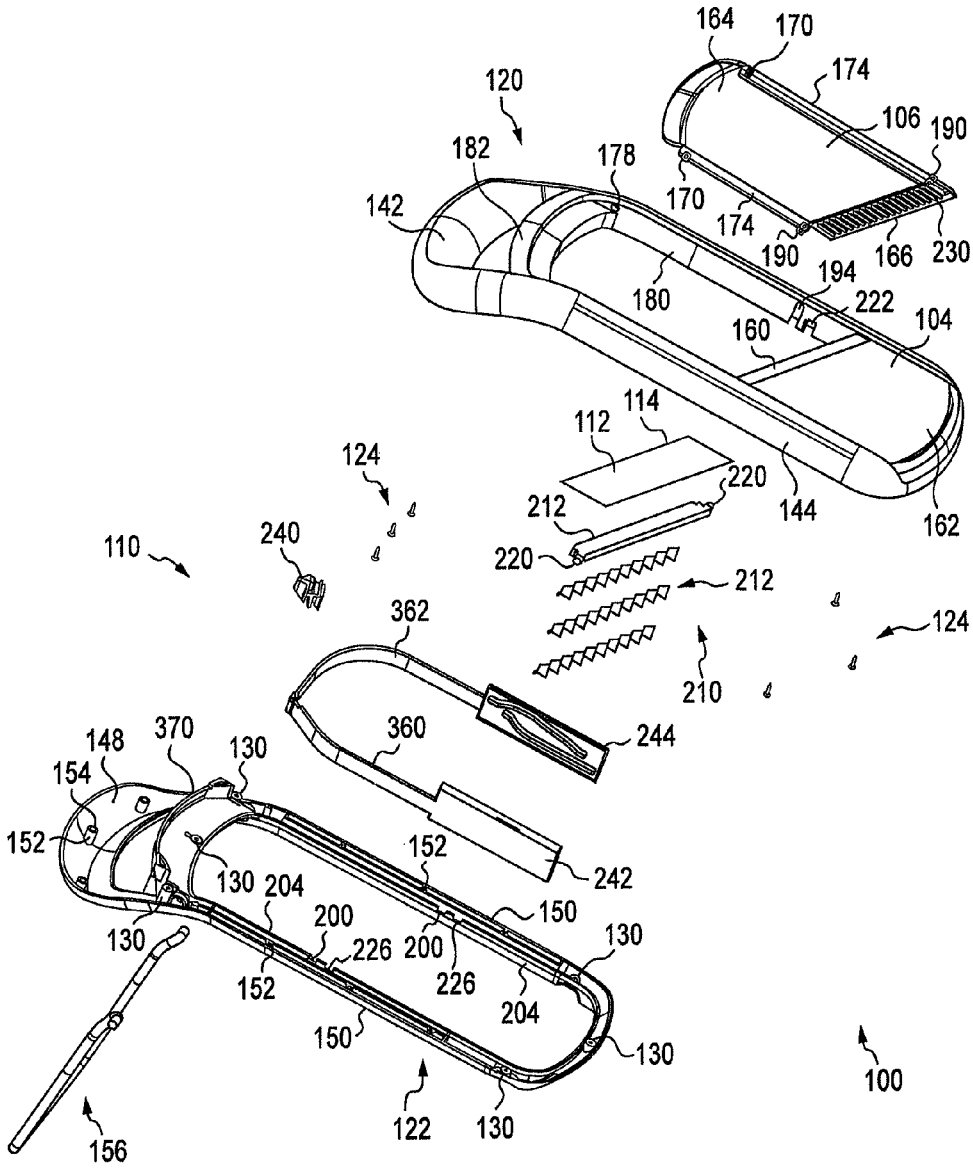
FIG. 2 is an exploded perspective view of the food slicer of FIG. 1.

Referring now to the drawings, wherein like numerals refer to like parts throughout the several views, FIGS. 1 and 2 illustrate an exemplary mandoline-type food slicer 100 according to the present disclosure for slicing food advanced in a cutting direction. The food slicer 100 includes a frame 102 for supporting an outfeed deck or landing 104 and an infeed deck or runway 106 between longitudinal sides 108 of the frame. The runway 106 is movable or tiltable relative to the landing 104 by an adjustment mechanism 110 so that a thickness of a slice of food made by the food slicer 100 can be selected. A cutting blade 112 is secured to the landing 104. During operation, food placed on the runway 106 is advanced toward a blade edge 114 of the cutting blade 112. As a portion of the food comes into contact with the blade edge 114, the cutting blade 112 begins to cut into the food to form a slice. Once the entire food is moved past the blade edge, the slice is separated from the food and passes through an opening underneath the blade. To enable this operation, the blade edge 114 is positioned above the runway 106 and selection of a slice thickness is made by the adjustment mechanism 110.

Figure 4:
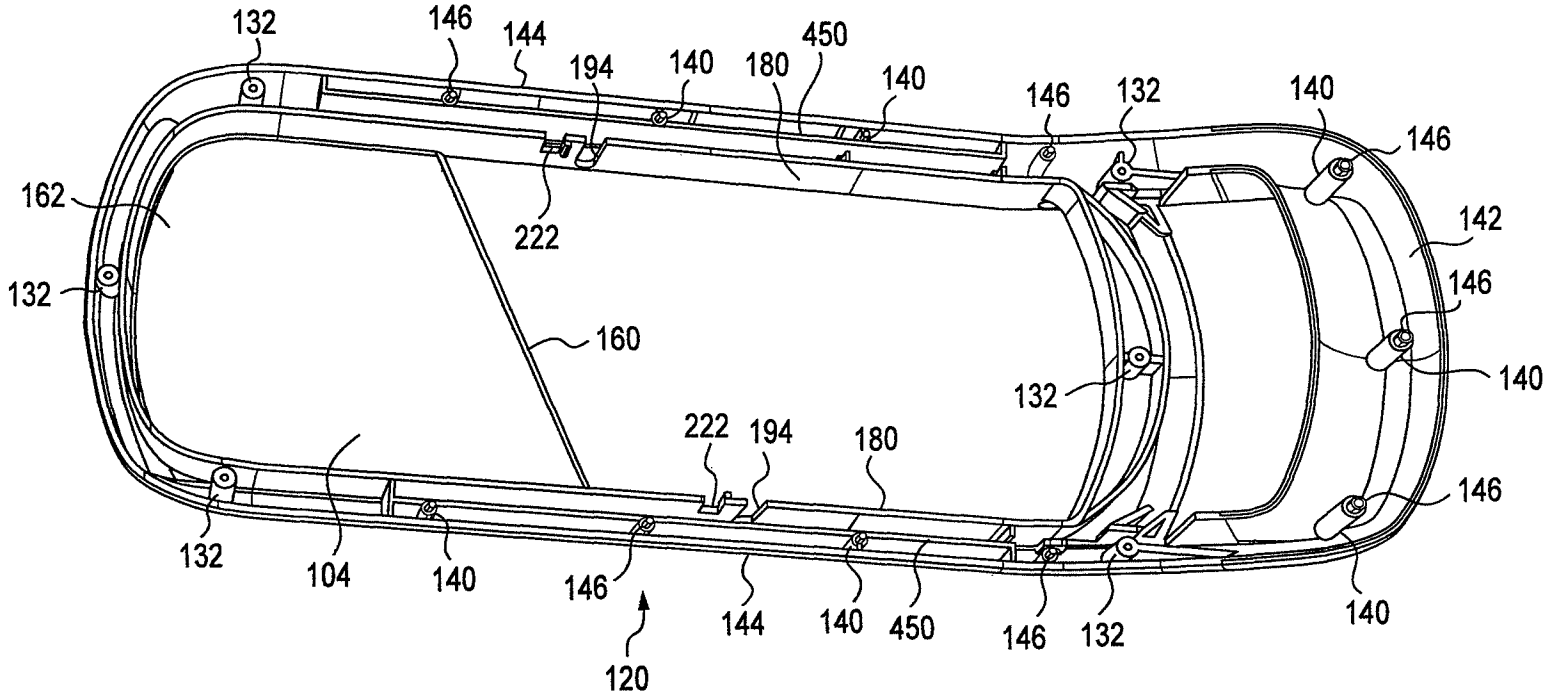
FIG. 4 is a bottom perspective view of the frame upper part of FIG. 3.

As shown, the frame 102 includes an upper part 120 and a lower part 122 secured to the upper part 120 by a plurality of fasteners, such as screws 124. The fasteners can extend through a plurality of first bosses 130 provided on the lower part 122 and engage corresponding first bosses 132 provided on the upper part 120 (FIG. 4). The upper and lower parts 120, 122 of the frame 102 also define a handle 138 for ease of transport as well as for steadying the food slicer 100 during use. To further secure the upper part to the lower part, a plurality of second bosses 140 are located on a handle portion 142 and along sides 144 of the upper part 120. Each of the second bosses 140 includes a projection 146 extending outwardly therefrom. A handle portion 148 and sides 150 of the lower part 122 includes a plurality of corresponding second bosses 152. Each of the second bosses 152 includes an opening 154 sized to securely receive therein one a projection of a corresponding second boss 140. Additionally, a stand 156 can be pivotally connected to the lower part 122 of the frame 102 so that the frame can be raised during use of the food slicer 100.

The landing 104 includes an upstream end 160 and a downstream end 162. Similarly, the runway 106 includes an upstream end 164 and a downstream end 166. The blade 112 is secured on a top side of the upstream end 160 of the landing 104. The downstream end 166 of the runway 104 is spaced or offset from the edge 114 of the blade 112 to define an opening for the passage of sliced food. The cutting blade 112 is substantially a planar member and a top surface of the landing is also substantially planar, and substantially co-planar with the cutting blade 112. For safety, the downstream end 166 of the runway 106 can include an elastomeric wing (not shown) configured to fill the space between the runway and landing. The runway 106 also has a substantially planar top surface on which an amount of food to be sliced, referred to herein as a food bulk, is initially placed. Both the landing 104 and runway 106 can include upstanding ridges which assist in moving the bulk food along the runway and landing by preventing sticking and an airlock condition during operation. During operation, the food bulk placed on the runway 106 is advanced towards the blade edge 114. As a portion of the food bulk comes into contact with the blade edge 114, the cutting blade 112 begins to cut into the food bulk to form a slice. Once the entire food bulk has passed by the blade edge 114, the slice is completed and is separated from the food bulk by passing underneath the blade 112. To enable this operation, the blade edge 114 is positioned at the offset or thickness (FIG. 14, e.g.) above that of the runway 106.

As is well known, the blade edge 114 of the cutting blade 102, despite cutting through the food bulk, provides a resistance force. For example, a straight blade edge that is perpendicular or transverse to the direction of cutting may require a relatively high force applied to the food bulk. The straight blade makes a line contact across a square face of the food bulk, and the entire blade edge enters the food bulk at generally the same time. To ease the entrance of the cutting blade 112 into the food bulk, the blade edge is at an angle from the direction of cutting (i.e., the edge 114 of the cutting blade is canted relative to a longitudinal axis defined by the frame 102). This allows a first portion of the blade 112 to enter the food at the oblique angle, and the rest of the blade edge 114 trails and enters subsequent to the first portion, thus requiring a lower initial force to begin a cut of the bulk food.

Figure 3:
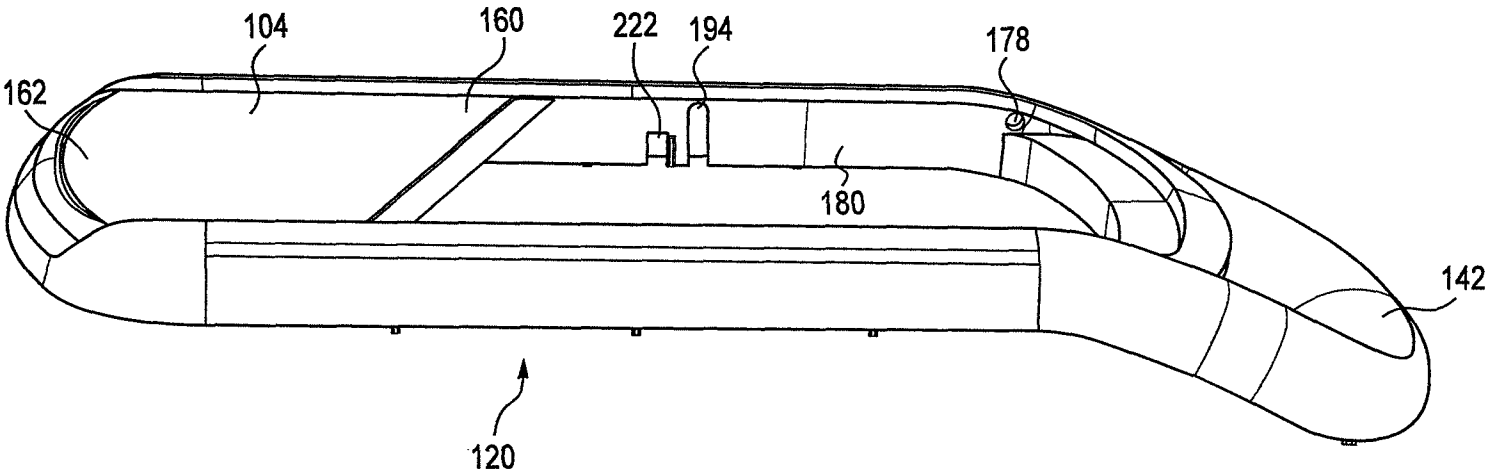
FIG. 3 is a side perspective view of an upper part of a frame including a landing.

As indicated previously, the runway 106 is movably connected to the frame 102. To this end, as and shown in FIGS. 2 and 3, the upstream end 164 of the runway includes pivot stubs or projections 170 located on its outwardly facing sides 174. The upper part 120 of the frame includes recesses or openings 178 located on inwardly facing surfaces 180 of the sides 144 proximate an upstream end 182 of the frame 102. The recesses 178 are sized to receive the pivot stubs 170, and the pivot stubs 170 define a pivot point or axis for the runway 106, around which the runway 106 is pivoted for slice thickness selection. Further, the downstream end 166 of the runway includes pivot stubs or projections 190 located on its outwardly facing sides 174. The inwardly facing surfaces 180 of the upper part 120 of the frame proximate the upstream end 160 of the landing 104 includes elongated (in the vertical direction) opening 194 sized to receive the pivot stubs 190. As can be seen in FIGS. 3 and 4, each opening 194 has a partial circle-shaped portion and downwardly extending open slot (i.e., an axis of the slot is substantially perpendicular to the longitudinal axis of the frame 102). As shown in FIG. 2, the lower part 122 of the frame 120 can include cutouts 200 located on inwardly facing surfaces 204 of the sides 150 which are aligned with the slots of the openings 194. The pivot stubs 190 are movable in the openings 194 and cutouts 200 as the runway 106 is pivoted to adjust a thickness of the sliced food bulk.

With reference again to FIG. 2, a separate cutting knife 210 can be movably connected to the frame 102. In the illustrated embodiment, the cutting knife 210 is a julienne cutting knife including an elongated bar 212 and a plurality of vertically standing julienne blades 214 attached to and extending upwardly from the bar 212. To connect the cutting knife 210 to the frame 102, extending outwardly from opposite ends of the bar 212 are projections 220. The projections 220 are displaceable in recesses 222 located on the inwardly facing surfaces 180 of the upper part 120 and interposed between the upstream end 160 of the landing 104 and the openings 194 (FIG. 4). The lower part 122 of the frame 120 can include corresponding cutouts 226 located on the inwardly facing surfaces 204 of the sides 150 which are aligned with the recesses 222. In a julienne position of the food slicer (FIG. 20), the julienne blades 214 project upwardly through openings 230 provided on the downstream end 166 of the runway 106. As the food bulk passes across the runway 106, vertical slices are made therein. Once cutting blade 112 passes through the food bulk, the combination of the vertical slices made by the vertical blades 212 and the horizontal blade 112 creates julienne slices of the food bulk.

Figure 5:
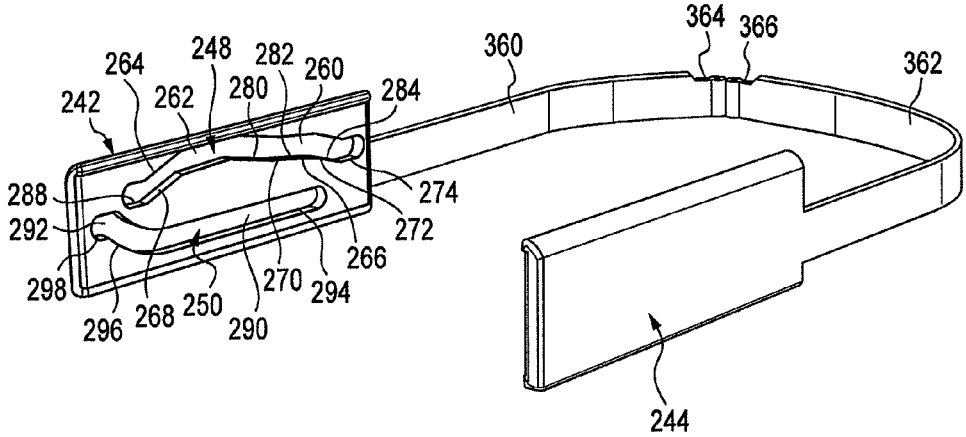
FIGS. 5 and 6 are perspective views of first and second movable side members of an adjustment mechanism of the food slicer of FIG. 1.
Figure 6:
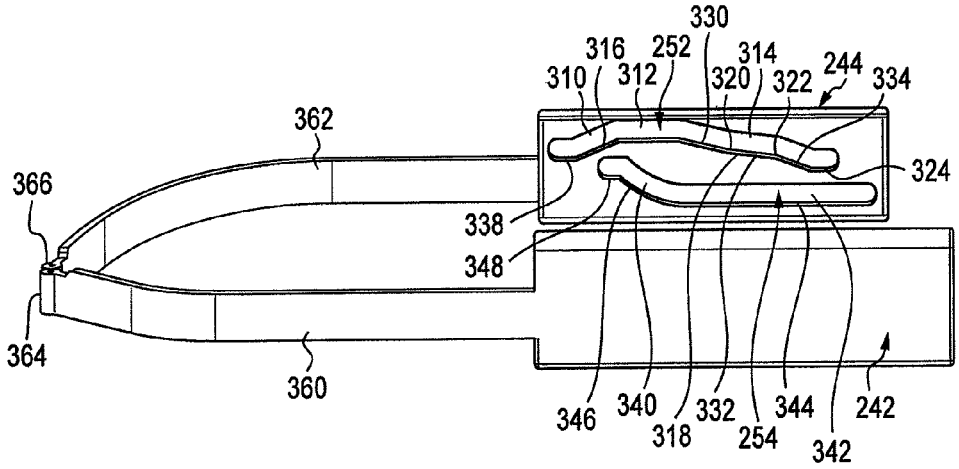

As indicated above, the adjustment mechanism 110 is connected to the frame 102 and configured to adjust an offset between the edge 114 of the cutting blade 112 and the downstream end 166 of the runway 106. In the depicted embodiment of FIG. 2, the adjustment mechanism 110 includes a selector or slide button 240 operably connected to first and second movable side members 242, 244 provided on opposed longitudinal sides 108 of the frame 102 and displaceable along a length of the frame. As best depicted in FIGS. 5 and 6, the first movable side member 242 includes spaced apart first and second guide tracks 248, 250. Similarly, the second movable side member 244 includes spaced apart first and second guide tracks 252, 254. The adjustment mechanism 110 simultaneously engages the runway 106 and the cutting knife 210 with the first guide tracks 248, 252 cooperating with the downstream end 166 of the runway 106 and the second guide tracks 250, 254 cooperating with the cutting knife 210. With this arrangement, a first movement of the adjustment mechanism 110 from a locked position (FIG. 12) of the food slicer 100 (i.e., a first lateral movement of the slide button 240 toward one of the sides of the frame 102) moves or lowers the downstream end 166 of the runway 106 relative to the cutting blade 112 to adjust a cutting thickness, and a second movement of the adjustment mechanism 110 from the locked position (i.e., a second lateral movement of the slide button 240) lowers the downstream end 166 of the runway 106 and simultaneously raises the cutting knife 210 to the working, julienne position. According to one aspect, the first and second movements of the adjustment mechanism 110 are in opposite directions that are substantially parallel to the edge 114 of the cutting blade 112.

As best shown in FIGS. 5, 6, 10 and 11, the orientation of the first and second guide tracks 252, 254 provided on the second movable side member 244 is substantially a mirror image of the orientation of the first and second tracks 248, 250 provided on the first movable side member 242 rotated 180 degrees about an axis transverse to the longitudinal axis defined by the frame 102 of the food slicer 100. Particularly, the first guide track 248 of the first movable side member 242 includes an upstream or forward section 260, a central section 262 and a downstream or rearward section 264, and defines a first sloping surface 266 between the central section 262 and the upstream section 260 and a second sloping surface 268 between the central section 262 and the downstream section 264. As depicted, a length of the first sloping surface is greater than a length of the second sloping surface, and each sloping surface 266, 268 is sloped toward the second guide track 250 from the central section 262. The first sloping surface 266 includes a first landing 270, a second landing 272 and a third landing 274. The first and second landings 270, 272 divide or separate the first sloping surface 266 into a first section 280, a second section 282 and a third section 284, with the first landing 270 interposed between the first and second sections 280, 282 and the second landing 272 interposed between the second and third sections 282, 284. The third landing 274 is provided at the forward most portion of the upstream section 260. A fourth landing 288 is provided at the rearward most portion of the downstream section 264. Although, it should be appreciated that the first guide track 248 can includes a single continuous sloping section that extends between the forward section 260 and rearward section 264 without any landings.

The second guide track 250 of the first movable side member 242 includes an upstream or forward section 290 and a downstream or rearward section 292 which is sloped relative to the upstream section 290. The upstream section 290 of the second guide track 250 includes a surface 294 that extends substantially parallel to the longitudinal axis of the food slicer 100. As shown, the downstream section 292 includes a sloping surface 296 sloped toward the downstream section 264 of the first guide track 248 from the upstream section 290, and a landing 298 is provided at the rearward most portion of the downstream section 262.

With particular reference to FIG. 6, the first guide track 252 of the second movable side member 244 includes an upstream or forward section 310, a central section 312 and a downstream or rearward section 314, and defines a first sloping surface 316 between the central section 312 and the upstream section 310 and a second sloping surface 318 between the central section 312 and the downstream section 314. As depicted, a length of the first sloping surface is less than a length of the second sloping surface, and each sloping surface 316, 318 is sloped toward the second guide track 254 from the central section 312. The second sloping surface 318 includes a first landing 320, a second landing 322 and a third landing 324. The first and second landings 320, 322 divide or separate the second sloping surface 318 into a first section 330, a second section 332 and a third section 334, with the first landing 320 interposed between the first and second sections 330, 332 and the second landing 322 interposed between the second and third sections 332, 334. The third landing 324 is provided at the rearward most portion of the downstream section 314. A fourth landing 338 is provided at the forward most portion of the upstream section 314. Again, it should be appreciated that the first guide track 252 can includes a single continuous sloping section that extends between the forward section 310 and rearward section 314 without any landings.

The second guide track 254 of the second movable side member 244 includes an upstream or forward section 340 and a downstream or rearward section 342. The upstream section 340 is sloped relative to the downstream section 342. The downstream section 342 of the second guide track 254 includes a surface 344 that extends substantially parallel to the longitudinal axis of the food slicer 100. As shown, the upstream section 340 includes a sloping surface 346 sloped toward the upstream section 310 of the first guide track 252 from the upstream section 310, and a landing 348 is provided at the forward most portion of the upstream section 340.

As depicted in FIGS. 5 and 6, a first arm 360 extends from the first movable side member 242 and a second arm 362 extends from the second movable side member 244, and respective ends 364, 366 of the first and second arms 360, 362 are configured to be connected to the slide button 240. The first and second arms 360, 362 are also flexible to translate a force applied to the adjustment mechanism 110 from a user into an adjustment force thereby allowing for smooth movement of the runway 106 and cutting knife 210. Further, in the depicted embodiment, with the angled orientation of the cutting blade 112, to locate the first and second movable side members 242, 244 an equal distance from the upstream end 160 of the landing 104, a length of the second arm 362 is greater than a length of the first arm 360. This difference in length allows the second movable side member 244 to be longitudinally offset from the first movable side member. As will be described in greater detail below, the first guide track 248 of the first movable side member 242 is vertically offset from the first guide track 252 of the second movable side member 244. This causes the downstream end 166 of the runway 106 to twist as the offset between the cutting blade 112 and the runway 106 is adjusted by the adjustment mechanism 110. This twisting provides for a substantially constant cutting thickness.

Figure 7:
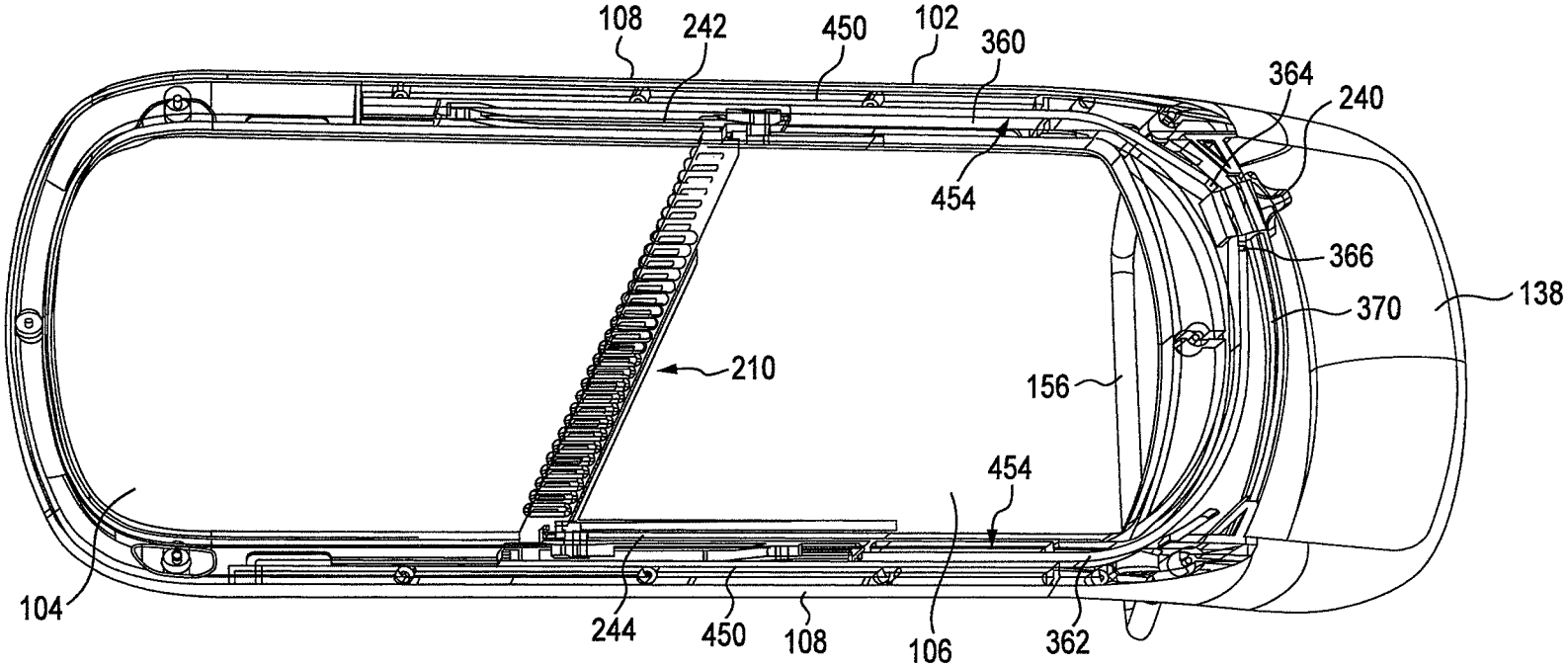
FIG. 7 is a top cross-sectional view of the food slicer of FIG. 1.
Figure 8:
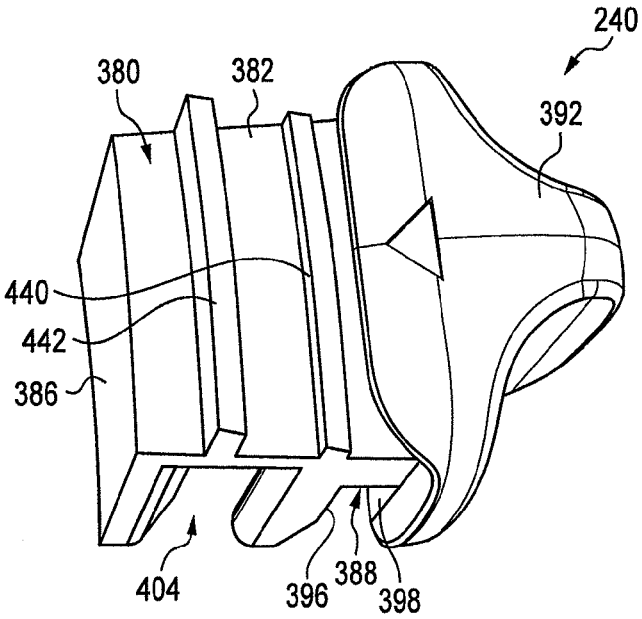
FIGS. 8 and 9 are perspective views of a slide button of the food slicer of FIG. 1.
Figure 9:
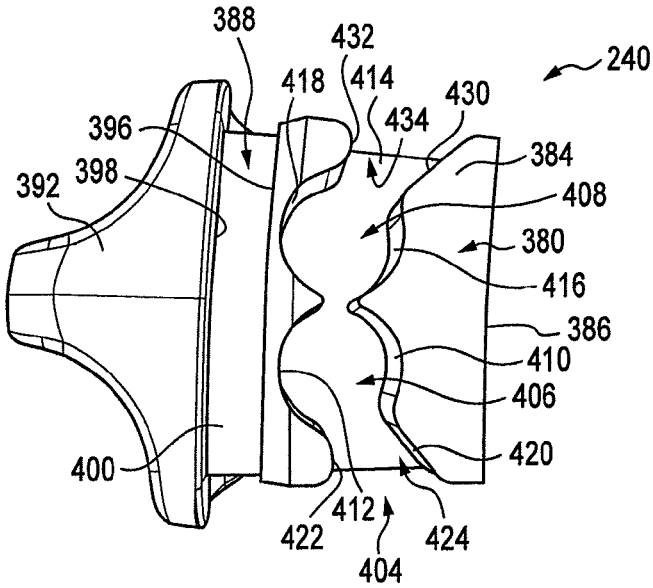
Figure 10:
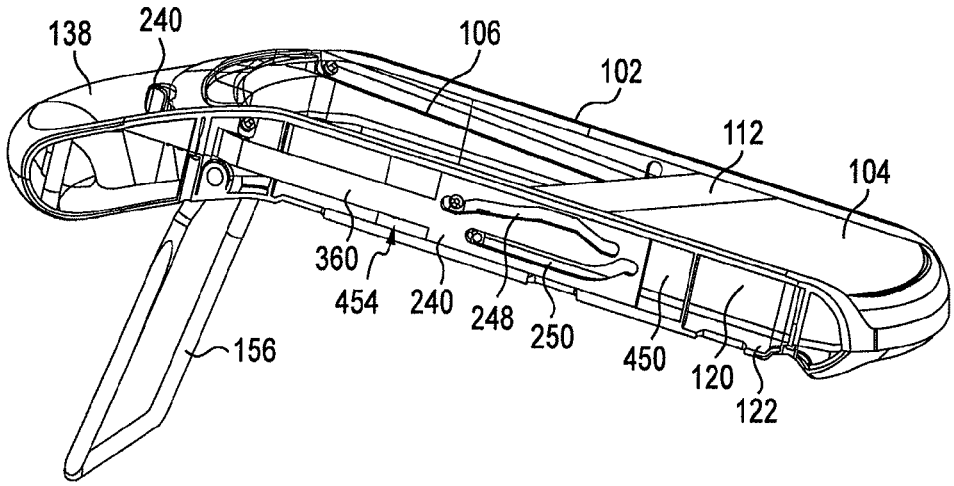
FIGS. 10 and 11 are side cross-sectional views of the food slicer of FIG. 1.
Figure 11:
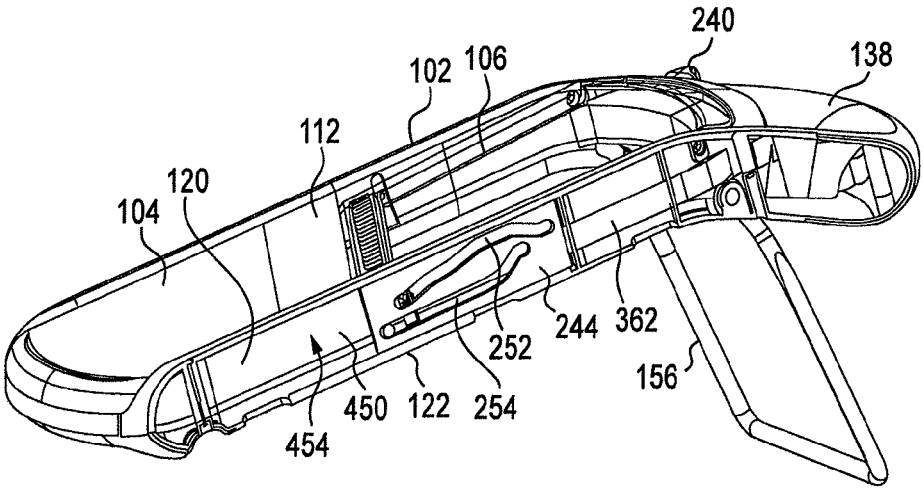

As shown in FIG. 7, the slide button 240 is provided at the upstream end 164 of the runway 106. To allow the slide button 240 to move laterally across the frame 102, the slide button is connected with a guide 370 extending laterally between the longitudinal sides 108 of the frame 102. The guide 370 can be curved toward the handle 138 (FIG. 2); although, this is not required. To connect the slide button 240 to the guide 370, and as shown in FIGS. 8 and 9, the slide button 240 includes a body 380 having an upper wall 382, a lower wall 384 and a sidewall 386. A first channel 388 is provided on the lower wall 384 adjacent a user grip portion 392. The first channel 388 is defined by opposed side surfaces 396, 398 and a base 400 and is dimensioned to receive therein the guide 370. A second channel 404 is provided on the lower wall 384 adjacent the sidewall 386. The second channel 404 includes a first portion 406 adapted to receive therein the end 364 of the first arm 360 and a second portion 408 adapted to received therein the end 366 of the second arm 362. In the depicted embodiment, the first portion 406 is defined by opposed, generally arcuate surfaces 410, 412 and a base 414, and the second portion 408 is defined by opposed, generally arcuate surfaces 416, 418 and the base 414. With this configuration, the first and second portions 406, 408 are generally cylindrical shaped to receive the generally barrel shaped ends 364, 366 of the first and second arms 360, 362. Further, ends 420, 422 of the respective surfaces 410, 412 are flared away from one another to define an enlarged first opening 424 into the first portion 406. Similarly, ends 430, 432 of the respective surfaces 416, 418 are flared away from one another to define an enlarged second opening 434. The enlarged first and second openings 424, 434 allow the ends 364, 366 of the respective first and second arms 360, 362 to pivot in the first and second portions 406, 408. This allows the first and second arms to flex during movement of the slide button, which, as indicated above, translates a force applied to the adjustment mechanism 110 from a user into an adjustment force thereby allowing for smooth movement of the runway 106 and cutting knife 210. A pair of elongated ribs 440, 442 can be located on the upper wall for spacing the body 380 from the upper part 120 of the frame 102.

To secure the first and second movable side members 242, 244 to the frame 102, the frame defines a channel configured to receive the first and second movable side members 242, 244 including their respective arms 360, 362. Particularly, and with reference to FIGS. 7, 10 and 11, the frame 102 includes longitudinally extending interior walls 450 spaced inwardly from the inwardly facing surfaces 180 of the sides 144 of the frame upper part 120 and from the inwardly facing surfaces 204 of the sides 150 of the frame lower part 122. The interior walls 450 together with the inwardly facing surfaces 180, 204 form longitudinally extending channels 454. The channels 454 are sized to allow for longitudinal displacement of the first and second movable side members 242, 244 upon movement of the slide button 240.

As indicated above, the pair of projections 170 provided at the upstream end 164 of the runway 106 is pivotally secured in corresponding openings 178 provided in the frame 102 and define a pivot axis for the runway 106. The pair of projections 190 provided at the downstream end 166 of the runway 106 is slidably received in the elongated opening 194 provided in the frame 102. The pair of projections 190 is also slidably received in the first guide tracks 248, 252 of the respective first and second movable side members 242, 244. With the projections 190 received in the elongated openings 194 provided in the frame 102, longitudinal movement of the projections 190 is precluded while vertical movement is allowed. The cutting knife 210 includes the projections 220 provided on opposite ends of the cutting knife. These projections 220 are slidably received in the frame recesses 222, which precludes longitudinal movement and allows vertical movement, and also in the second guide tracks 250, 254 of the respective first and second movable side members 242, 244. The slide button 240 provided at the upstream end 164 of the runway 106 allows the operator to select the offset between the downstream end 166 of the runway and the blade edge 114. To adjust the thickness of a food slice, a user moves the slide button 240 to one of a first position, a second position, and a third position. Movement of the slide button to one of the predetermined positions moves the first and second movable side members 242, 244 which, in turn, moves the downstream end 166 of the runway 106. The slide button 240 is also movable to a fourth position which again displaces the first and second movable side members 242, 244 to raise the cutting knife 210 to the julienne position.

Figure 12:
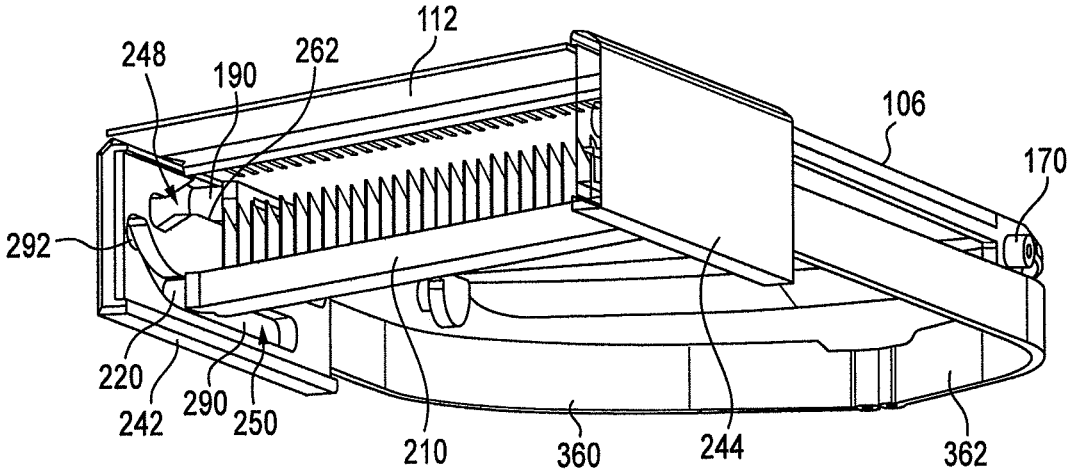
FIG. 12 is a perspective view of the first and second movable side members of the adjustment mechanism together with a runway of the frame of the food slicer of FIG. 1 in a locked position.
Figure 13:
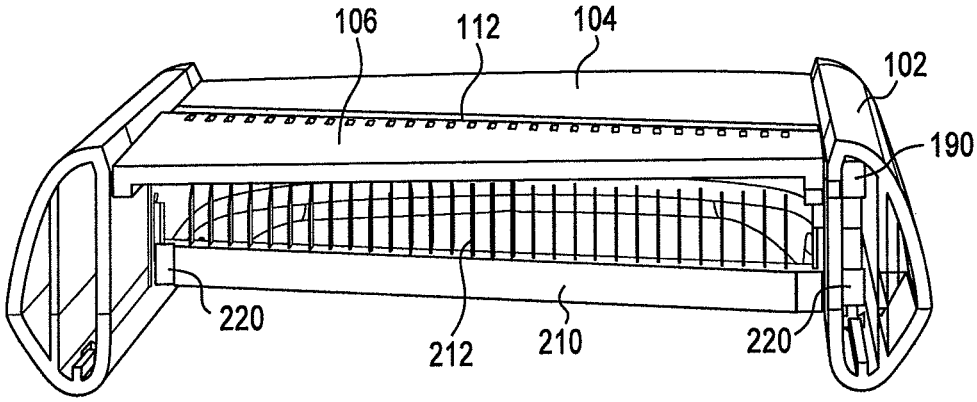
FIG. 13 is a front cross-sectional view of the food slicer of FIG. 1 in the locked position.

More particularly, as shown in FIGS. 12 and 13, the first and second movable side members 242, 244 of the adjustment mechanism 100 are in a locked position. In the locked position, the surfaces of the runway 106, cutting blade 112 and landing 104 are substantially coplanar (i.e. there is no opening between the downstream end 166 of the runway and the edge 114 of the cutting blade 112 for the passage of sliced food). In the locked position, the projections 190 of the runway 106 are located in the central section 262, 312 of each of the first guide tracks 248, 252 of the first and second side members 242, 244. One of the projections 220 provided on the cutting knife 210 is located at the rearward most portion of the upstream section 290 of the second guide track 250 of the first movable side member 242, and the other projection 220 is located at the forward most portion of the downstream section 342 of the second guide track 254 of the second movable side member 244.

Figure 14:
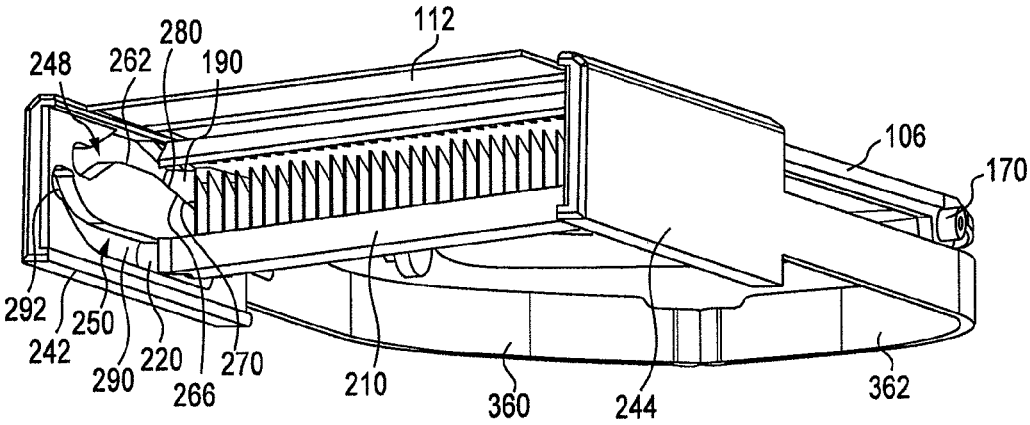
FIG. 14 is a perspective view of the first and second movable side members of the adjustment mechanism together with the runway of the frame of the food slicer of FIG. 1 in a first position.
Figure 15:
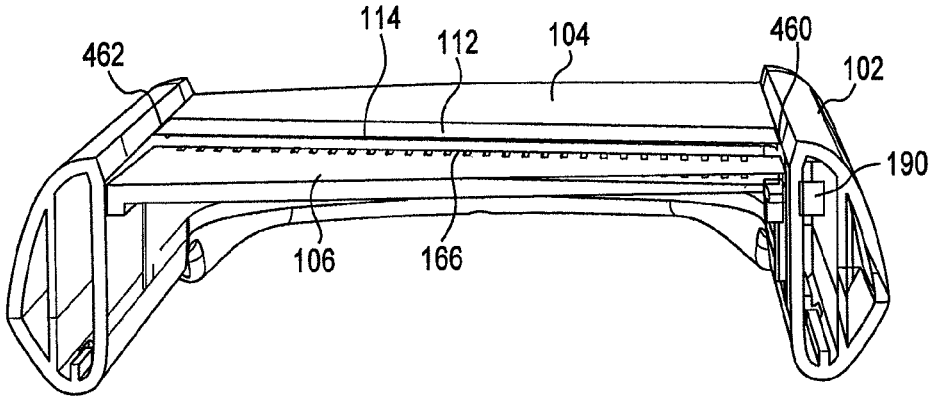
FIG. 15 is a front cross-sectional view of the food slicer of FIG. 1 in the first position.

FIGS. 14 and 15 depict the first and second movable side members 242, 244 of the adjustment mechanism 110 in a first position. The first movement of the slide button 240 of the adjustment mechanism 110 longitudinally displaces the first and second movable side members 242, 244, which, in turn, move the projections 190 on the downstream end 166 of the runway 106 from the central section 262 toward the upstream section 260. The projection 190 received in the first guide track 248 of the first movable side member 242 slides along the first section 280 of the first sloping surface 266 toward the first landing 270. The projection 190 received in the first guide track 252 of the second movable side member 244 slides along the first section 330 of the second sloping surface 318 toward the first landing 320. The first movement also simultaneously moves one of the cutting knife projections 220 along the upstream section 290 of the second guide track 250 away from the downstream section 292, and moves the other projection 220 along the downstream section 342 of the second guide track 254 away from the upstream section 340. In this first position, the downstream end 166 of the runway 106 is spaced from the edge 114 of the cutting blade 112 and defines a first opening for the passage of sliced food.

Figure 16:
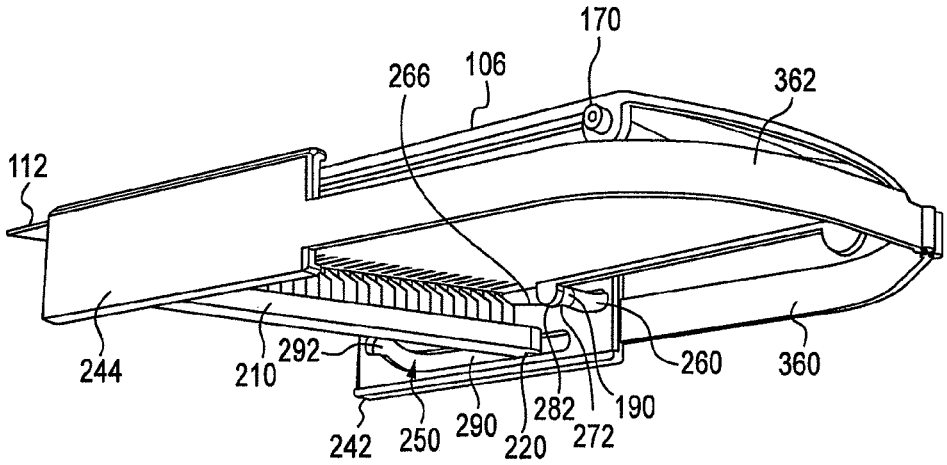
FIG. 16 is a perspective view of the first and second movable side members of the adjustment mechanism together with the runway of the frame of the food slicer of FIG. 1 in a second position.
Figure 17:
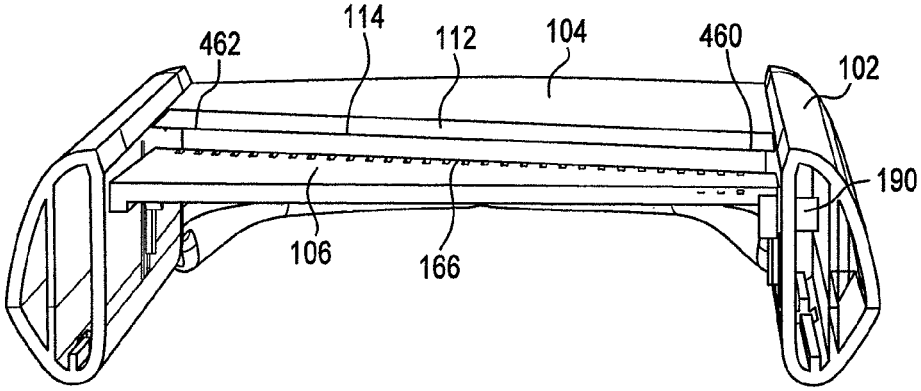
FIG. 17 is a front cross-sectional view of the food slicer of FIG. 1 in the second position.

FIGS. 16 and 17 depict the first and second movable side members 242, 244 of the adjustment mechanism 110 in a second position. Continued first movement of the slide button 240 of the adjustment mechanism 110 further longitudinally displaces the first and second movable side members 242, 244. The projection 190 received in the first guide track 248 of the first movable side member 242 slides along the second section 282 of the first sloping surface 266 toward the second landing 272. The projection 190 received in the first guide track 252 of the second movable side member 244 slides along the second section 332 of the second sloping surface 318 toward the second landing 322. The projection 220 of the cutting knife 210 located in the second guide track 250 simultaneously moves further along the upstream section 290, and the projection 220 located in the second guide track 254 moves further along the downstream section 342. In this second position, the downstream end 166 of the runway 106 is further spaced from the edge 114 of the cutting blade 112 and defines a second opening for the passage of sliced food. Additionally, because first guide track 248 of the first movable side member 242 is vertically offset from the first guide track 252 of the second movable side member 244, the downstream end 166 of the runway 106 begins to twist about a longitudinal axis as the offset between the cutting blade 112 and the runway 106 increases. More particularly, the side of the runway 106 nearer the first moveable side member 242, which is located adjacent an upstream side edge 460 of the blade edge 114, moves away from the cutting blade 112 more as the offset increases as compared to the downstream side of the runway 106 nearer the second moveable side member 244 and a downstream side edge 462 of the blade edge 114. This twisting maintains a constant vertical dimension for the second opening thereby providing for a food slice having a constant thickness.

Figure 18:
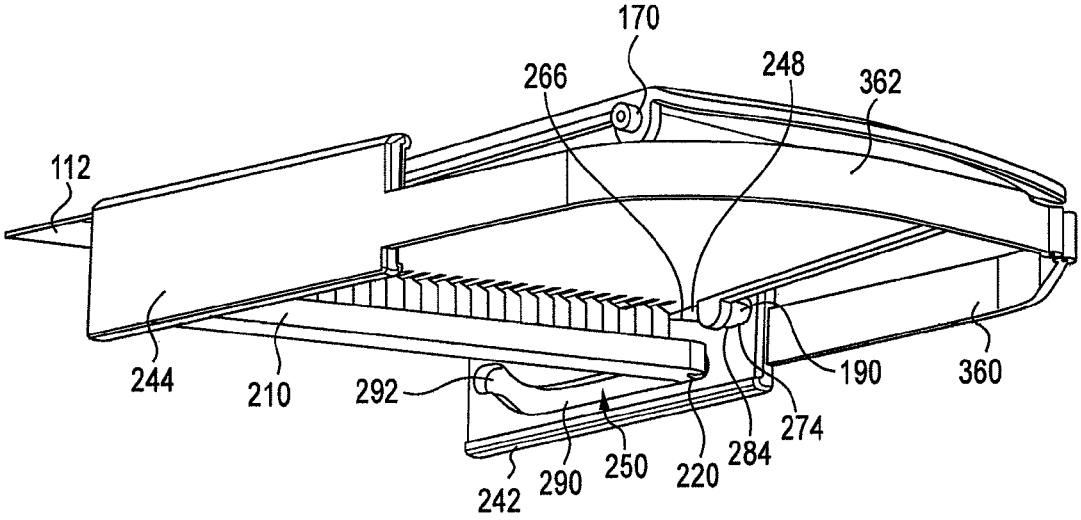
FIG. 18 is a perspective view of the first and second movable side members of the adjustment mechanism together with the runway of the frame of the food slicer of FIG. 1 in a third position.
Figure 19:
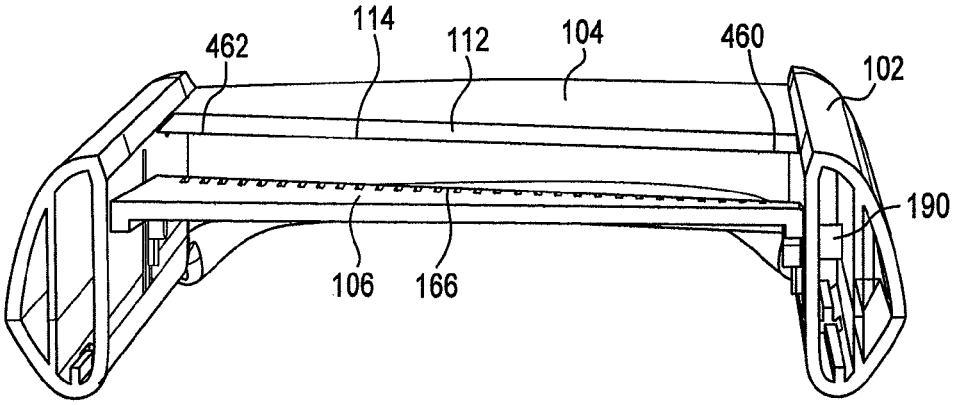
FIG. 19 is a front cross-sectional view of the food slicer of FIG. 1 in the third position.

FIGS. 18 and 19 depict the first and second movable side members 242, 244 of the adjustment mechanism 110 in a third position. Continued first movement of the slide button 240 of the adjustment mechanism 110 further longitudinally displaces the first and second movable side members 242, 244. The projection 190 received in the first guide track 248 of the first movable side member 242 slides along the third section 284 of the first sloping surface 266 toward the third landing 274. The projection 190 received in the first guide track 252 of the second movable side member 244 slides along the third section 334 of the second sloping surface 318 toward the third landing 324. The projection 220 of the cutting knife 210 located in the second guide track 250 simultaneously moves further along the upstream section 290, and the projection 220 located in the second guide track 254 moves further along the downstream section 342. In this third position, the downstream end 166 of the runway 106 is further spaced from the edge 114 of the cutting blade 112 and defines a third opening for the passage of sliced food. Additionally, the downstream end 166 of the runway 106 is twisted about the longitudinal axis even further as the offset between the cutting blade 112 and the runway is further increased. Again, this twisting maintains a constant dimension for the third opening thereby providing for a food slice having a constant thickness.

Figure 20:
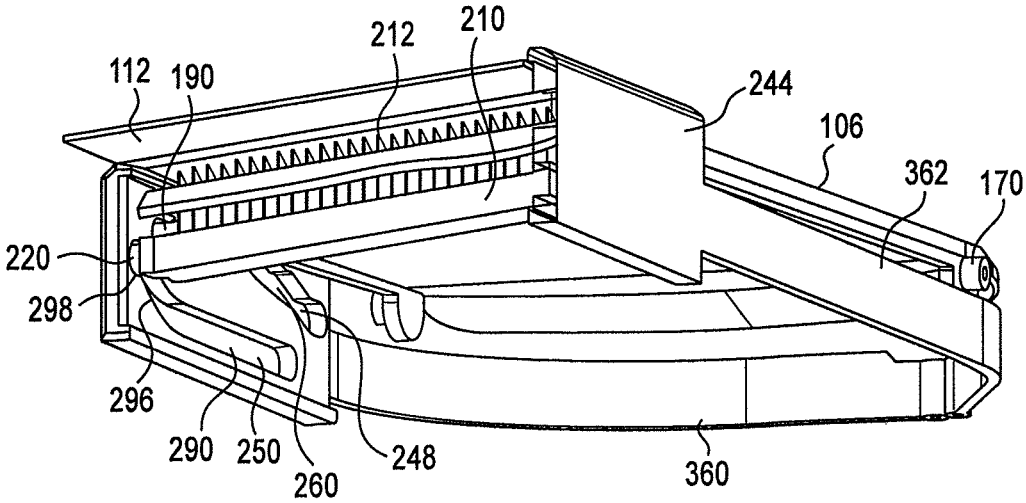
FIG. 20 is a perspective view of the first and second movable side members of the adjustment mechanism together with the runway of the frame of the food slicer of FIG. 1 in a working, julienne position.
Figure 21:
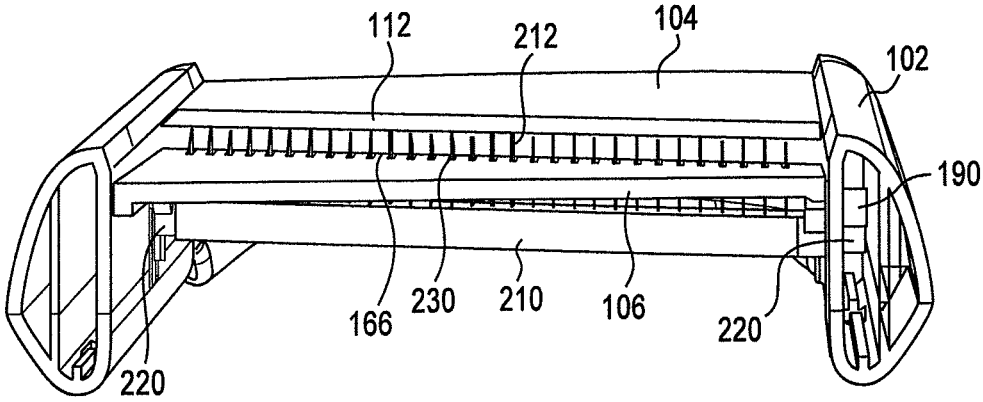
FIG. 21 is a front cross-sectional view of the food slicer of FIG. 1 in the julienne position.

FIGS. 20 and 21 depict the first and second movable side members 242, 244 of the adjustment mechanism 110 in a working, julienne position. As indicated previously, the second movement of the adjustment mechanism moves one of the projections 190 located on the downstream end 166 of the runway 106 along the second sloping surface 268 of the first guide track 248 of the first movable side member 242 from the central section 262 toward the downstream section 264. The other projection 190 moves along the second sloping surface 316 of the first guide track 252 of the second movable side member 242 from the central section 312 toward the upstream section 310. This moves or pivots the downstream end 166 of the runway downwardly toward the cutting knife 210. The projection 220 of the cutting knife 210 simultaneously moves toward the downstream section 292 of the second guide track 250 of the first movable side member 242, and the other projection 220 moves toward the upstream section 340 of the second guide track 254 of the second moveable side member 244. This displaces the cutting knife 210 upwardly toward the runway 106 and raises the julienne blades 212 through the openings 230 provided on the runway 106.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A mandoline-type food slicer for slicing food advanced in a cutting direction, the food slicer comprising:

a frame for supporting a landing and a runway, which is movable relative to the landing;

a cutting blade secured on an upstream end of the landing, a downstream end of the runway being spaced from an edge of the cutting blade to define an opening for the passage of sliced food;

a separate cutting knife moveably connected to the frame; and an adjustment mechanism connected to the frame and configured to adjust an offset between the cutting blade and the runway, the adjustment mechanism including spaced apart first and second guide tracks provided on respective first and second movable side members, wherein the first and second guide tracks are configured such that a first movement of the adjustment mechanism from a locked position of the food slicer lowers the downstream end of the runway relative to the cutting blade to adjust a cutting thickness and a second movement of the adjustment mechanism from the locked position lowers the downstream end of the runway and raises the cutting knife to a working position.

2. The food slicer of claim 1, wherein the adjustment mechanism includes a slide button provided at an upstream end of the runway, and the first and second movements of the adjustment mechanism are in opposite directions that are substantially parallel to the edge of the cutting blade.

3. The food slicer of claim 2, wherein a first arm extends from the first movable side member and a second arm extends from the second movable side member, respective ends of the first and second arms are connected to the slide button.

4. The food slicer of claim 3, wherein a length of the second arm is greater than a length of the first arm, and the second movable side member is longitudinally offset from the first movable side member.

5. The food slicer of claim 3, wherein the frame defines a channel configured to receive the first and second movable side members and the first and second arms of the respective first and second movable side members.

6. The food slicer of claim 3, wherein the first and second arms are flexible to translate a force applied to the adjustment mechanism from a user into an adjustment force thereby allowing for smooth movement of the runway and cutting knife.

7. The food slicer of claim 1, wherein the orientation of the first and second tracks provided on the second movable side member is substantially a mirror image of the orientation of the first and second tracks provided on the first movable side member rotated 180 degrees about an axis transverse to a longitudinal axis defined by the food slicer.

8. The food slicer of claim 1, wherein the first guide track of the first movable side member is vertically offset from the first guide track of the second movable side member causing the downstream end of the runway to twist as the offset between the cutting blade and the runway is adjusted by the adjustment mechanism.

9. The food slicer of claim 1, wherein the adjustment mechanism simultaneously engages the runway and the cutting knife, the first guide tracks cooperating with the downstream end of the runway and the second guide tracks cooperating with the cutting knife.

10. The food slicer of claim 1, wherein the first guide track of the first movable side member includes an upstream section, a central section and a downstream section, and defines a first sloping surface between the central section and the upstream section and a second sloping surface between the central section and the downstream section, wherein the first movement of the adjustment mechanism moves the downstream end of the runway along the first sloping surface from the central section toward the upstream section and the second movement of the adjustment mechanism moves the downstream end of the runway along the second sloping surface from the central section toward the downstream section.

11. The food slicer of claim 10, wherein the first guide track of the second movable side member includes an upstream section, a central section and a downstream section, and defines a first sloping surface between the central section and the downstream section and a second sloping surface between the central section and the upstream section, wherein the first movement of the adjustment mechanism moves the downstream end of the runway along the first sloping surface from the central section toward the downstream section and the second movement of the adjustment mechanism moves the downstream end of the runway along the second sloping surface from the central section toward the upstream section.

12. The food slicer of claim 1, wherein the second guide track of the first movable side member includes an upstream section and a downstream section which is sloped relative to the upstream section, wherein the second movement of the adjustment mechanism moves the cutting knife toward the downstream section.

13. The food slicer of claim 12, wherein the second guide track of the second movable side member includes an upstream section and a rearward section, the upstream section is sloped relative to the rearward section, wherein the second movement of the adjustment mechanism moves the cutting knife toward the upstream section.

14. A mandoline-type food slicer for slicing food advanced in a cutting direction, the food slicer comprising:

a frame for supporting a landing and a runway, which is movable relative to the landing;

a cutting blade secured on an upstream end of the landing, a downstream end of the runway being spaced from an edge of the cutting blade to define an opening for the passage of sliced food; and an adjustment mechanism connected to the frame and configured to adjust an offset between the cutting blade and the runway, the adjustment mechanism including a slide button connected to first and second movable side members provided on opposed longitudinal sides of the frame, each of the first and second movable side members includes a first guide track, wherein each first guide track is configured such that a first lateral movement of the slide button from a locked position of the food slicer lowers a downstream end of the runway relative to the cutting blade to adjust a cutting thickness, and wherein the first guide track of the first movable side member is vertically offset from the first guide track of the second movable side member causing the downstream end of the runway to twist as the offset between the cutting blade and the runway is adjusted by the adjustment mechanism.

15. The food slicer of claim 14, wherein the orientation of the first track provided on the second movable side member is substantially a mirror image of the orientation of the first track provided on the first movable side member rotated 180 degrees about an axis transverse to a longitudinal axis defined by the food slicer.

16. The food slicer of claim 14, wherein a first arm extends from the first movable side member and a second arm extends from the second movable side member, respective ends of the first and second arms are connected to the slide button, and wherein the first and second movable arms are flexible to translate a force applied to the slide button from a user into an adjustment force thereby allowing for smooth movement of the runway.

17. The food slicer or claim 14, wherein the first and second movable side members are displaceable along a length of the frame.

18. The food slicer of claim 14, wherein:

the runway includes a first pair of projections provided at the downstream end thereof which are slidably received in the first guide tracks of the respective first and second movable side members and a second pair of projections provided at an upstream end thereof which are pivotally secured in corresponding openings provided in the frame, the second pair of projections defining a pivot axis for the runway.

19. A mandoline-type food slicer for slicing food advanced in a cutting direction, the food slicer comprising:

a frame for supporting a landing and a runway, which is movable relative to the landing;

a cutting blade secured on an upstream end of the landing, a downstream end of the runway being spaced from an edge of the cutting blade to define an opening for the passage of sliced food;

a separate cutting knife moveably connected to the frame, the second cutting knife having julienne blades which project upwardly through openings provided on the downstream end of the runway; and an adjustment mechanism connected to the frame and configured to adjust an offset between the cutting blade and the runway, the adjustment mechanism including first and second movable side members which are displaceable along a length of the frame and a slide button, each of the first and second movable side members includes spaced apart first and second guide tracks, and further including a first arm extending from the first movable side member and a second arm extending from the second movable side member, respective ends of the first and second arms are connected to the slide button, and wherein the first and second guide tracks are configured such that a movement of the slide button in a first direction generally perpendicular to a longitudinal axis of the food slicer raises a downstream end of the runway relative to the cutting blade to adjust a cutting thickness and a second movement of the slide button in the first direction lowers the downstream end of the runway and simultaneously raises the cutting knife.

20. The food slicer of claim 19, wherein the first guide track of the first movable side member is vertically offset from the first guide track of the second movable side member causing the downstream end of the runway to twist as the offset between the cutting blade and the runway is adjusted by the adjustment mechanism.

* * * * *

UNITED STATES PATENT AND TRADEMARK OFFICE

CERTIFICATE OF CORRECTION

PATENT NO. : 8,919,234 B2
APPLICATION NO. : 13/755109
DATED : December 30, 2014
INVENTOR(S) : Aby-Eva et al.

It is certified that error appears in the above-identified patent and that said Letters Patent is hereby corrected as shown below:

In the Claims,

In Column 12, line 51, change "or" to --of--

Signed and Sealed this
Fourteenth Day of April, 2015

Michelle K. Lee

Michelle K. Lee
*Director of the United States Patent and Trademark Office*